US005823862A

United States Patent [19]

Heidelberger

[11] Patent Number: 5,823,862

[45] Date of Patent: Oct. 20, 1998

[54] DUAL ACTION SANDER

[75] Inventor: Richard A. Heidelberger, Wheatfield, N.Y.

[73] Assignee: Dynabrade, Inc., Clarence, N.Y.

[21] Appl. No.: 804,009

[22] Filed: Feb. 21, 1997

[51] Int. Cl.[6] ..... B24B 23/00; B24B 27/08

[52] U.S. Cl. ..... 451/344; 451/357; 403/22

[58] Field of Search ..... 451/342, 344, 451/350, 353, 357, 359, 360; 83/571; 279/7, 140; 403/22, 375

[56] References Cited

U.S. PATENT DOCUMENTS

| | | | |
|---|---|---|---|
| 2,794,303 | 6/1957 | Wickes | 51/170 |
| 4,854,085 | 8/1989 | Huber | 51/170 |
| 5,144,872 | 9/1992 | Kakimoto | 451/571 |
| 5,425,666 | 6/1995 | Frank et al. | 451/344 |

*Primary Examiner*—James G. Smith
*Assistant Examiner*—Derris H. Banks
*Attorney, Agent, or Firm*—Bean, Kauffman & Snyder

[57] ABSTRACT

A dual action sander having a manually manipulated housing, a motor supported by the housing, a motor shaft balancer driven by the motor for rotation relative to the housing about a drive axis, a balancer shaft carried by the motor shaft balancer for rotation relative thereto about a second axis radially offset relative to the drive axis and for mounting a sanding device, a latch pin slidably supported by the motor shaft balancer for movement in alignment with the drive axis between unlatched and latched positions, the latch pin having a first end and a second end with the first end being engageable with the balancer shaft when the latch pin is in latched position for preventing rotation of the balancer shaft relative to the motor shaft balancer about the second axis, a manual operator carried by the housing for engagement with the second end of the latch pin and being movable to force the latch pin into latched position, and a spring for biasing the latch pin for movement towards the unlatched position.

7 Claims, 2 Drawing Sheets

FIG. 2
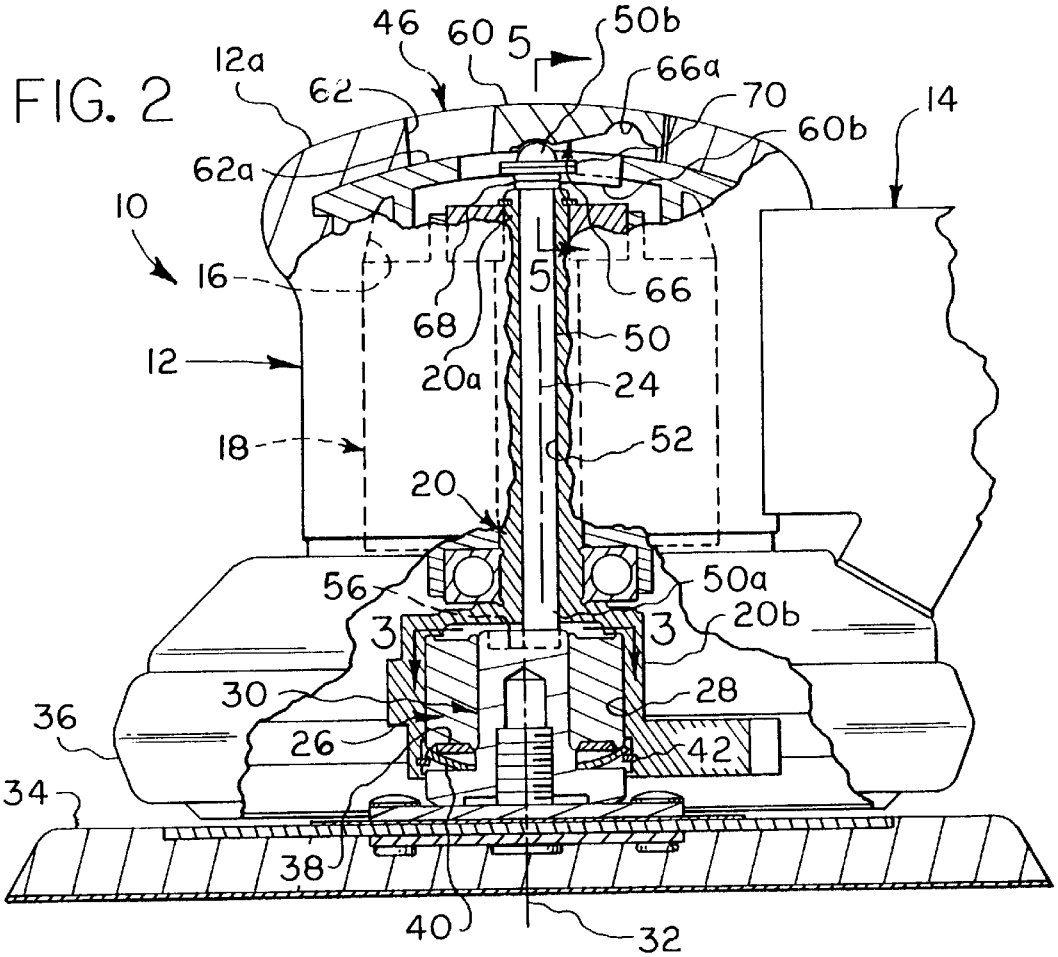
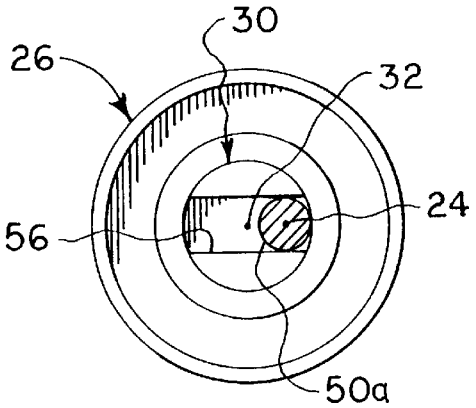
FIG. 3
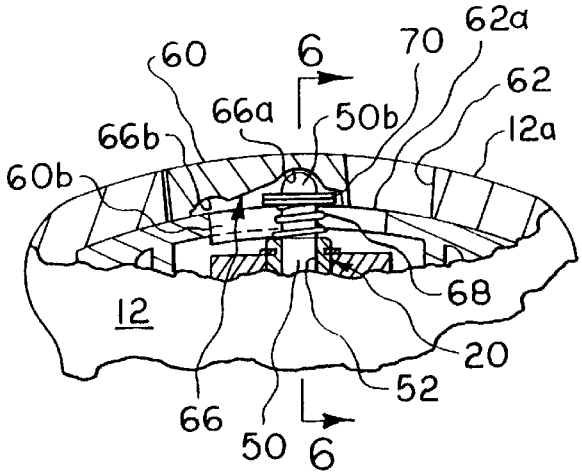
FIG. 4

DUAL ACTION SANDER

BACKGROUND OF THE INVENTION

A dual action sander manually adjustable to selectively drive a sanding device, such as a pad mounting a sand paper disc, for either random orbital movement or orbital movement is disclosed by U.S. Pat. No. 2,794,303.

Dual action sanders formed in accordance with U.S. Pat. No. 2,794,303 have enjoyed wide commercial success, particularly in the automobile aftermarket, wherein the sander is adapted, when operated in the orbital mode, for heavy stock removal, while providing a finish superior to that produced by a typical rotary disc sander. In the random orbital mode, a very fine finish may be obtained.

A disadvantage of this prior dual action sander is in the construction of the locking device employed to retain the sander in its orbital mode. This device features a detent formed as part of a relatively thin sheet metal ring, which is supported on a motor shaft balancer for pivotal or swinging movement for purposes of removably inserting the detent into a radially opening recess formed in a side wall of a sanding device supporting balancer shaft or spindle. The detent is subject to deformation rendering it difficult to properly seat the detent in the recess after extended usage. Further, the mode of supporting the detent requires that the sander motor be turned off before the ring can be manually manipulated for detent insertion/removal purposes.

SUMMARY OF THE INVENTION

The present invention is directed to an improved dual action sander not having the disadvantages of prior commercial sanders formed in accordance with U.S. Pat. No. 2,794,303, and more particularly to an improved locking mechanism for such sanders.

In accordance with the present invention, a latch pin is supported for reciprocation between latched and unlatched positions under the control of a housing mounted control member, which can be operated for purposes of changing between the operating modes of the sander without need for turning off the sander drive motor.

Further, that portion of the latch pin arranged for latching engagement with the balancer shaft or spindle for purposes of locking the sander in its orbital mode may be formed of relatively heavy stock material, such as will maximize resistance to deformation.

BRIEF DESCRIPTION OF THE DRAWINGS

The nature and mode of operation of the present invention will now be more fully described in the following detailed description taken with the accompanying drawings wherein:

FIG. 2 is a partial, vertical sectional view showing the sander in its orbital mode;

FIG. 3 is an enlarged sectional view taken generally along the line 3—3 in FIG. 2;

FIG. 4 is a fragmentary sectional view similar to FIG. 2, but showing the sander in its random orbital mode;

DETAILED DESCRIPTION

Figure 1:
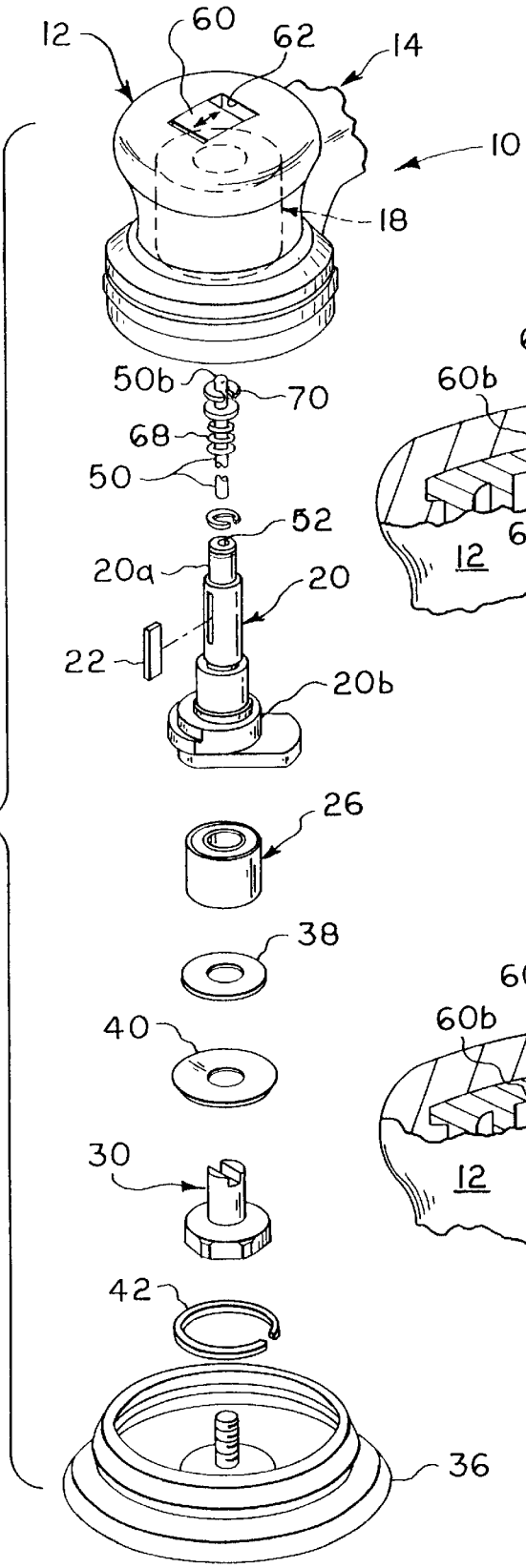
FIG. 1 is a fragmentary, partially exploded view of a dual action sander incorporating the present invention.

Reference is first made to FIGS. 1 and 2, wherein a pneumatically driven sander formed in accordance with the present invention is designated as 10 and shown as generally including a housing 12 formed with a manually manipulated handle 14 and a downwardly opening recess 16; a drive motor 18 mounted within the recess; a motor shaft balancer 20 coupled to the motor by a key 22 and adapted to be driven by the motor for rotation about a drive or first axis 24; a bearing 26 fitted within a downwardly opening recess 28 defined by the motor shaft balancer; a balancer shaft 30 carried by the motor shaft balancer via the bearing for free rotational movement relative to the motor shaft balancer about a second axis 32 radially offset relative to the drive axis; a sanding pad 34 removably fixed to the balancer shaft; a shroud 36 depending from the housing; and a seal assembly including a bearing seal 38, a bearing shield 40 and a snap fitted retainer 42. As thus far described, sander 10 is structurally similar to the random orbital sander disclosed in U.S. Pat. No. 4,854,085 whose disclosure is incorporated by reference.

Present sander 10 differs from that described in U.S. Pat. No. 4,854,085 in that its manually operable, air flow control device, not shown, is arranged to wholly overlie handle 14, so that the upper surface 12*a* of housing 12 is unobstructed; and in that a locking means 46 is provided for releasably locking balancer shaft 30 against rotation about second axis 32 relative to motor shaft balancer 20, whereby to provide sander 10 with a dual action sanding capability similar to that described in U.S. Pat. No. 2,794,303.

In accordance with the present invention, locking means 46 preferably includes latch means in the form of a latch pin 50 slidably supported for movement lengthwise of a mounting opening 52 formed in motor shaft balancer 20 and extending in alignment with drive axis 24. Mounting opening 52 extends through a motor shaft portion 20*a* and a balancer portion 20*b* of motor shaft balancer 20 and opens into recess 28, as best shown in FIG. 2. Latch pin 50 has a first or lower end 50*a* arranged to removably engage within a slot 56 formed in balancer shaft 30 to extend transversely of second axis 32 and to open relatively towards recess 28, when the latch pin is moved into a lowermost or latched position shown in FIGS. 2 and 3 in the manner to be described. Engagement of latch pin 50 within slot 56 locks balancer shaft 30 against rotation about second axis 32 relative to motor shaft balancer 20.

Latch pin 50 has a second or upper end 50*b* arranged to normally project outwardly from the upper end of mounting opening 52 for engagement with a sander operator thumb operated control member 60, which is supported for sliding movement lengthwise of a guide slot 62 formed in housing 12 to extend transversely of drive axis 24. Support for control member 60 may be provided by forming housing 12 with outwardly facing, parallel slide surfaces 62*a* and 62*a* arranged to underengage parallel lower edge surfaces 60*a* and 60*a* of member 60. Member 60 may be retained in sliding engagement with the housing by forming the member with resiliently deformable, dependant latch members 60*b* and 60*b* arranged to snap under the edges of slot 62, as shown in FIGS. 5 and 6.

Figure 5:
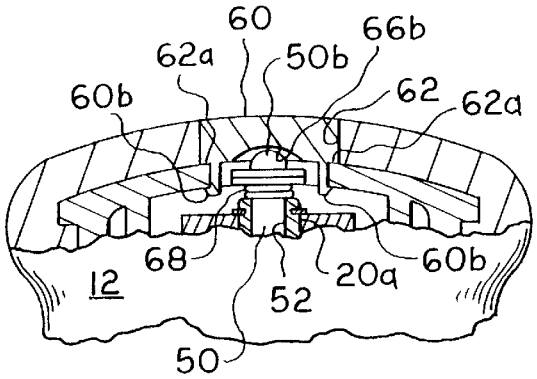
FIG. 5 is a sectional view taken generally along the line 5—5 in FIG. 2.
Figure 6:
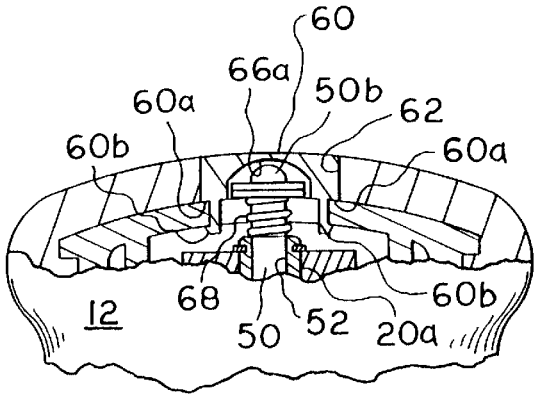
FIG. 6 is a sectional view taken generally along the line 6—6 in FIG. 4.

Control member 60 is formed with a downwardly facing cam surface or ramp 66, which is arranged to slidably contact latch pin upper end 50*b*, such that latch pin 50 may be driven downwardly from its unlatched position shown in FIGS. 4 and 6 into its latched position shown in FIGS. 2 and 5 incident to manually induced sliding displacement of the control member to the right as viewed in FIG. 4. Latch pin 50 may be freed for return to its unlatched position under the bias of a coil return or compression spring 68 by manually sliding member 60 to the left, as viewed in FIG. 2. The opposite ends of cam surface 66 are provided with downwardly facing latching recesses 66*a* and 66*b* adapted to removably engage with latch pin 50 for purposes of releasably latching the latch pin alternatively in its unlatched and latched positions, respectively.

Spring 68 is shown as being arranged between the upper end of motor shaft portion 20*a* and a retaining ring 70 snap fitted to latch pin upper end 50*b* for purposes of providing a resilient bias tending to move latch pin 50 upwardly away from its latched position for return to its unlatched position upon manually induced movement of control member 60 into its release or inoperative position viewed in FIG. 4.

In view of the foregoing, it will be understood that manual movement of control member 60 to the right, as viewed in FIG. 4, serves to drive latch pin 50 into its lower latched position, wherein it latches balancer shaft 30 against rotation relative to motor shaft balancer 20 about a second axis 32, whereas manual movement of the control member to the left, as viewed in FIG. 2, permits spring 68 to bias the latch pin for return into its unlatched position, wherein the latch pin is removed from slot 56 and the balance shaft is free to rotate about the second axis.

An advantage of the present construction is that an operator may manipulate control member 60 for purposes of changing between the operating modes of sander 10, while motor 18 is in an idling condition.

While the present invention has been described for use with a pneumatic motor operated sander, it is contemplated that the invention has utility for use with electric motor operated sanders.

What is claimed is:

1. A dual action sander comprising in combination:

a housing;

a motor supported by the housing;

a motor shaft balancer driven by said motor for rotation relative to said housing about a drive axis;

a balancer shaft carried by said motor shaft balancer for rotation relative thereto about a second axis radially offset relative to said drive axis and having means for mounting a sanding device; and locking means for releasably locking said balancer shaft against rotation relative to said motor shaft balancer, said locking means including latch means supported for movement lengthwise of said drive axis between unlatched and latched positions, and a manually operable control member for moving said latch means from said unlatched position into said latched position, said latch means when in said unlatched position freeing said balancer shaft for rotation relative to said motor shaft balancer and when in said latched position engaging with said balancer shaft to lock same against rotation relative to said motor shaft balancer.

2. The sander according to claim 1, wherein said control member is a manually operable member supported by said housing for movement transversely of said drive axis.

3. The sander according to claim 1, wherein said latch means is mounted for sliding movement lengthwise of said motor shaft balancer in alignment with said drive axis.

4. The sander according to claim 1, wherein said motor shaft balancer has a mounting opening extending therethrough in alignment with said drive axis, said latch means is an elongated latch pin slidably supported within said mounting opening and having a first end arranged to removably engage with said balancer shaft when in said latched position and a second end, and said control member is mounted by said housing for engagement with said second end and movable relative to said housing to effect sliding movement of said latch pin to place said first end in engagement with said balancer shaft.

5. The sander according to claim 4, wherein said latch pin is resiliently biased towards said unlatched position.

6. The sander according to claim 1, wherein said motor shaft balancer includes a motor shaft portion extending axially through said motor in alignment with said drive axis and a balancer portion, said balancer portion having a recess for mounting a bearing, said motor shaft balancer having a mounting opening extending in alignment with said drive axis axially through said motor shaft portion and through said balancer portion to open into said recess, said balancer shaft being mounted by said bearing for rotation about said second axis, said latch means is an elongated latch pin slidably supported within said mounting opening and a slot defined by said balancer shaft to extend transversely of said second axis and open towards said recess, said latch pin having a first end removably engageable within said slot for locking said balancer shaft against rotation relative to said motor shaft balancer when in said latched position and a second end, and said control member is mounted by said housing for engagement with said second end to effect movement of said latch pin from said unlatched position into said latched position.

7. The sander according to claim 6, wherein said control member is slidably supported by said housing for movement transversely of said drive axis and is formed with a cam surface engaging with said second end of said latch pin, and said latch pin is resiliently biased for movement towards said unlatched position, wherein said first end of said latch pin is removed from within said slot.

* * * * *